US006000351A

United States Patent [19]

Yoshida et al.

[11] Patent Number: 6,000,351

[45] Date of Patent: Dec. 14, 1999

[54] SEWING MACHINE SYSTEM

[75] Inventors: Shinii Yoshida, Nagoya; Kazushi Inoue, Aichi-gun; Yoshihiro Hara, Kasugai; Minoru Yamaguchi, Kariya, all of Japan

[73] Assignee: Brother Kogyo Kabushiki Kaisha, Aichi-ken, Japan

[21] Appl. No.: 09/087,110

[22] Filed: May 29, 1998

[30] Foreign Application Priority Data

May 29, 1997 [JP] Japan ..... 9-140334

[51] Int. Cl.[6] ..... D05B 21/00

[52] U.S. Cl. ..... 112/470.04; 112/102.5; 112/445; 112/475.19

[58] Field of Search ..... 112/102.5, 470.06, 112/470.04, 445, 456, 458, 457, 475.19; 364/470.09

[56] References Cited

U.S. PATENT DOCUMENTS 4,960,061 10/1990 Tajima et al. .

5,156,107 10/1992 Kyuno et al. ..... 112/445

5,253,599 10/1993 Hashiride ..... 112/102.5

5,361,714 11/1994 Hartwig ..... 112/445

5,474,000 12/1995 Mizuno et al. ..... 112/102.5

*Primary Examiner*—Peter Nerbun

*Attorney, Agent, or Firm*—Kane, Dalsimer, Sullivan and Levy, LLP

[57] ABSTRACT

A sewing machine system provided with an electronically controlled sewing machine and a programmer, which is electronically connected to the sewing machine, for creating a sewing data in cooperation with the sewing machine. A selecting switch is provided and, when sewing data is being created, a user can switch a display condition of a displaying device of the programmer between a first mode for displaying numerical data related to currently created sewing data, and a second mode for displaying an image of the pattern in accordance with the sewing data which is being created.

14 Claims, 10 Drawing Sheets

SEWING MACHINE SYSTEM

BACKGROUND OF THE INVENTION

The present invention relates to a sewing machine system including an electronically controlled sewing machine which is capable of performing an automatic sewing operation in accordance with a sewing data, and a programmer, which operates in association with the sewing machine, to prepare sewing data.

Heretofore, such an electronically controlled sewing machine has been known that a sewing operation is carried out automatically in accordance with a sewing data. In this type of sewing machine, a frame member movable along X and Y coordinates, which are defined on a plane perpendicular to a sewing needle, is placed below the sewing needle, a material (e.g., cloth) to be sewn being fixedly held to be moved together therewith. The frame member thus carrying the material to be sewn is moved by a drive motor for a certain amount defined in sewing data and a needle rod and a loop taker mechanism are driven to stitch. By repeating this process, the sewing operation is executed in accordance with the sewing data.

In the programmer of a conventional sewing system, stitch points are sequentially input using operation keys to create the sewing data which represents a series of stitch points. The sewing data is created, for example, by inputting a plurality of significant points, and the intermediate points having a predetermined pitch are interpolated between the significant points.

FIG. 7A is a chart schematically illustrating creation of the sewing data.

Firstly, a plurality of significant points S0, S1, S2, . . . , Sn along a pattern P to be sewn are input by an operator. The significant points are points on the pattern P and defining the shape or outline of the pattern. Then, intermediate points between successive two significant points are interpolated, by calculation, automatically. The intermediate points may be determined, for example, by a linear interpolation. Thus obtained points, (i.e. the significant points), the significant points and the intermediate points are points to be stitched, and are stored in a data recording medium such as a flexible disk or the like as sewing data.

It should be noted that the sewing data includes, in addition to the above-described stitch points data, supplemental data such as sewing speed data, thread cutting data and so on. For simplifying the description, such supplemental data will not be described in this specification.

When the sewing data is created, usually, the significant points are input, as numerical values, using operation keys provided on the programmer. In a conventional programmer, the input numerical values are displayed on a liquid crystal display or the like so that the operator can confirm the input values.

During preparation of the sewing data, however, progress is indicated only by the numerical values representing the stitch points. Although an experienced operator may do it, it is difficult to imagine the pattern or figure which would be formed when the input data is used for automatic sewing operation. In order to confirm that the intended pattern is formed, it is necessary to actually load the data in the electronically controlled sewing machine, and carry out the automatic sewing operation.

SUMMARY OF THE INVENTION

It is therefore an object of the present invention to provide an improved sewing machine system which enables even an inexperienced operator to easily recognize the pattern which would be formed in accordance with the sewing data that is being created.

According to an aspect of the invention, there is provided a sewing machine system, comprising: an electronically controlled sewing machine; a programmer which is electronically connected to the sewing machine, the sewing machine being capable of performing an automatic sewing operation in accordance with sewing data, the programmer being capable of creating sewing data by inputting a positional data in cooperation with the sewing machine, the programmer comprising: a display device for visually displaying data; and an image data generating device that generates image data based on the sewing data being created by the programmer, and the programmer operating in either one of a confirmation mode and a data input mode, the display device displaying a numerical data related to input positional data when the programmer operating in the data input mode, and the display device displaying an image of a pattern representing a sewing data, which is being created, in accordance with the image data generated by the image data generating device when the programmer operates in the confirmation mode.

The above sewing machine system enables even an inexperienced operator to easily recognize the pattern which would be formed in accordance with the sewing data that is being created when the confirmation mode is selected, while the sewing data can be created when the data input mode is selected.

Preferably, the programmer may include a controller which prohibits data input when the programmer operates in the confirmation mode.

Optionally, the display device may display alphanumerical information related to the image of the pattern together with the image of the pattern when the programmer operates in the confirmation mode.

Because of the alphanumerical information and the pattern image are displayed, the operator can imagine the actual pattern which would be formed on a cloth or the like clearly.

In particular, the alphanumerical information may include an actual size of the pattern. If the displaying device is not a color display, it is advantageous if names of colors may be displayed. In addition, it is preferable that various supplemental information is displayed together with the pattern image.

According to another aspect of the invention, there is provided a sewing machine system which includes an electronically controlled sewing machine and a programmer electronically connected to the sewing machine, the sewing machine being capable of performing an automatic sewing operation in accordance with sewing data, the programmer being capable of creating sewing data in cooperation with the sewing machine, the programmer comprising: a display device for visually displaying data; an image data generating device that generates image data based on the sewing data being created by the programmer; a selecting device which is manually operated to select one of a first mode and a second mode; a display control device that controls the display device to display numerical data related to currently created sewing data when the first mode is selected by the selecting device, and to display an image of a pattern corresponding to the currently created sewing data in accordance with the image data generated by the image data generating device.

Optionally, the display control device may control the display to display an alphanumerical information related to the pattern together with the image of the pattern when the second mode is selected.

In particular, the alphanumerical information may include an actual size of the pattern when it is formed by the electronically controlled sewing machine.

Further optionally, the sewing machine system may include a controller which prohibits creation of the sewing data when the second mode is selected and the image of the pattern is being displayed.

Further optionally, the programmer may include: positional data input device that inputs positional data representing a plurality of points located on a pattern to be formed; and an interpolating device that interpolates positional data of intermediate points between the plurality of points located on the pattern to be formed.

According to further aspect of the invention, there is provided a programmer which is connected to an electrically controlled sewing machine, the sewing machine being capable of performing an automatic sewing operation in accordance with a sewing data, the programmer being capable of creating sewing data by inputting a positional data in cooperation with the sewing machine, the programmer comprising: a display device for visually displaying data; and an image data generating device that generates image data based on the sewing data being created by the programmer, and the programmer operating in either one of a confirmation mode and data input mode, the display device displaying a numerical data related to input positional data when the programmer operating in the data input mode, and the display device displaying an image of a pattern representing sewing data, which is being created, in accordance with the image data generated by the image data generating device when the programmer operates in the confirmation mode.

According to furthermore aspect of the invention, there is provided a method of displaying sewing data employed in a sewing machine system including an electronically controlled sewing machine and a programmer, the sewing machine being capable of performing an automatic sewing operation in accordance with a sewing data, the programmer being capable of creating sewing data by inputting positional data in cooperation with the sewing machine, the programmer having a displaying device, the method comprising the steps of: allowing a user to create sewing data; allowing a user to switch a display mode of the displaying device between a first mode and a second mode when the sewing data is allowed to be created; displaying alphanumerical characters on the displaying device when the first mode is selected; generating an image data representing a pattern image in accordance with a sewing data currently created and displaying the pattern image on the displaying device when the second mode is selected.

Optionally, the method further includes a step of displaying alphanumerical information related to the pattern together with the pattern image when the second mode is selected.

Further, the method may include a step of prohibiting creation of the sewing data when the second mode is selected.

According to yet another aspect of the invention, there is provided a computer accessible memory for storing program to be executed by a computer, the program contains a method for displaying sewing data employed in a sewing machine system including an electronically controlled sewing machine and a programmer, the sewing machine being capable of performing an automatic sewing operation in accordance with sewing data, the programmer being capable of creating a sewing data by inputting a positional data in cooperation with the sewing machine, the programmer having a displaying device, the method comprising the steps of: allowing a user to create sewing data; allowing a user to switch a display mode of the displaying device between a first mode and a second mode when the sewing data is allowed to be created; displaying alphanumerical characters on the displaying device when the first mode is selected; and generating an image data representing a pattern image in accordance with sewing data currently created and displaying the pattern image on the displaying device when the second mode is selected.

DESCRIPTION OF THE ACCOMPANYING DRAWINGS

DESCRIPTION OF THE PREFERRED EMBODIMENTS

The invention will be described with reference to the accompanying drawings.

Figure 1:
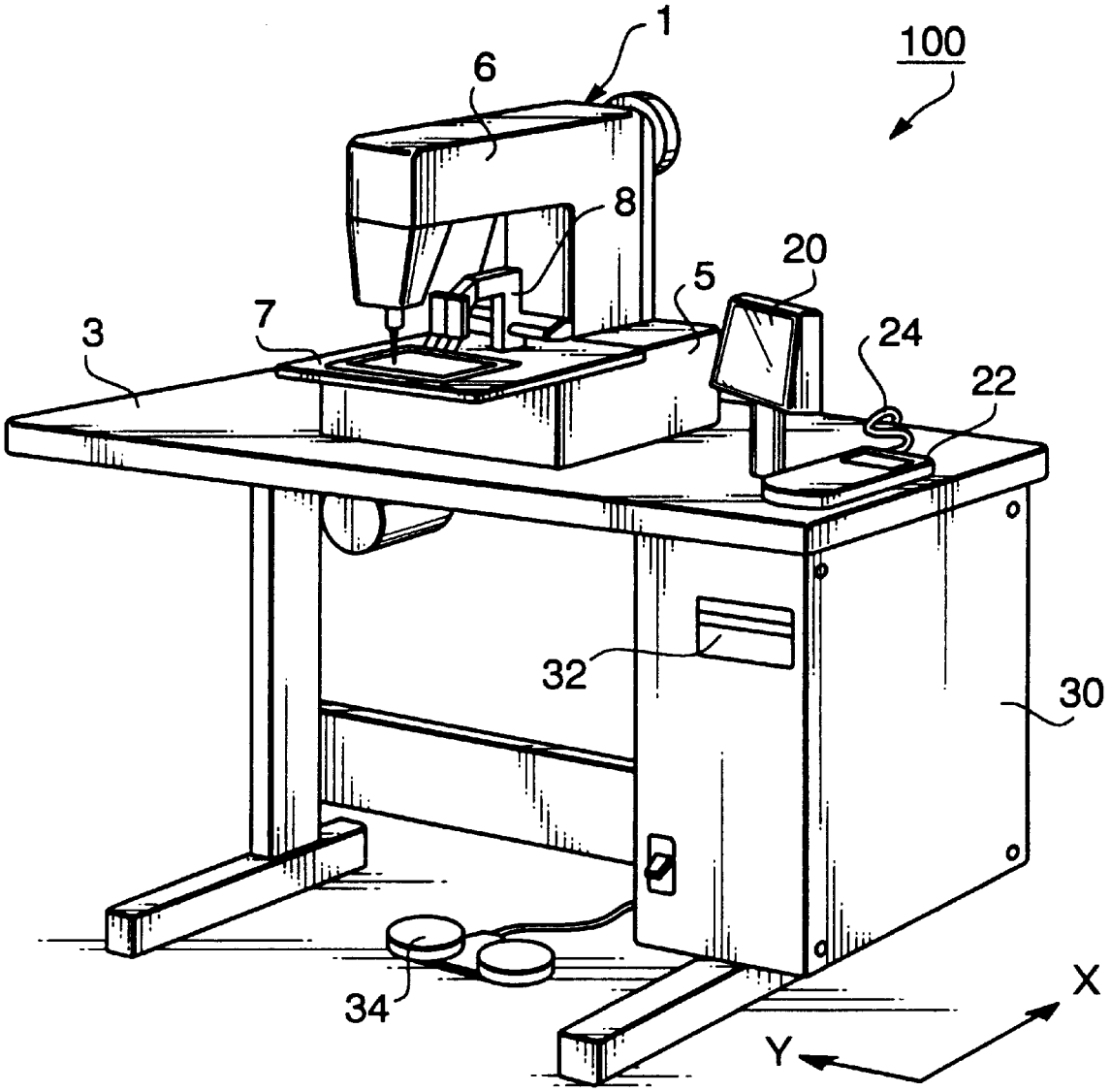
FIG. 1 is a perspective view of an electronically controlled sewing machine system according to an embodiment of the invention.

FIG. 1 is a perspective view of a sewing machine system 100 according to an embodiment of the invention.

The sewing machine system 100 includes an electronically controlled sewing machine 1 which is mounted on a sewing desk 3. The sewing machine 1 has a machine bed 5, and on the machine bed 5, an arm unit 6 is mounted. On the upper front surface of the machine bed 5, a work table 7 is fixedly secured, and on the work table 7, a cloth holding device 8 is provided. The cloth holding device 8 holds and moves a working cloth to be sewn in a horizontal direction, i.e., in X and Y directions which are indicated in FIG. 1.

Figure 2:
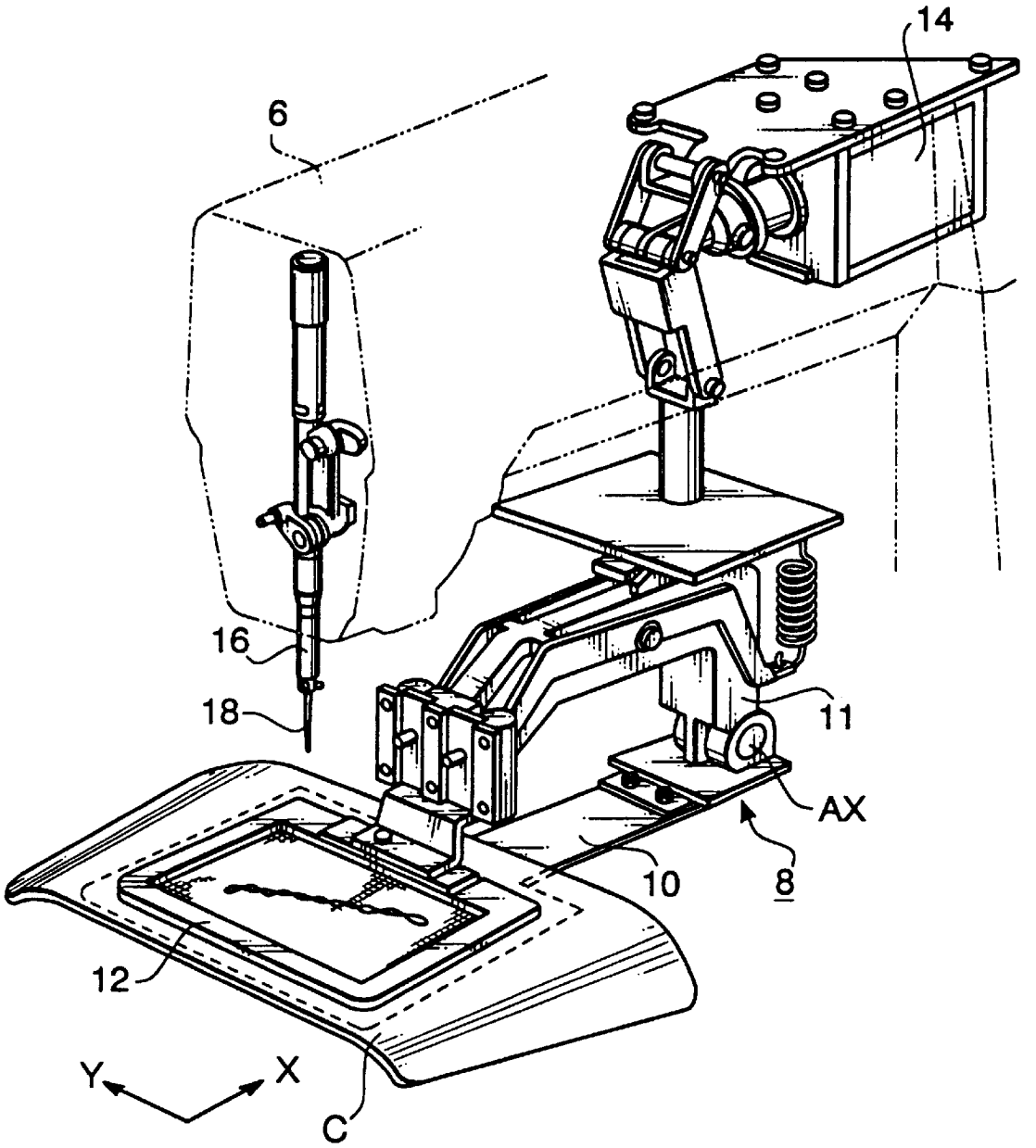
FIG. 2 is an enlarged perspective view of a sewing machine.

FIG. 2 is an enlarged perspective view of the arm unit 6 and the cloth holding device 8. The cloth holding device 8 includes a movable plate 10 which is movable in the X and Y directions, an arm 11 secured on an upper surface of the movable plate 10, a frame member 12 which is provided at a front end portion of the arm 11. The frame member 12 is, together with the arm 11, rockable about an axis AX so as to be movable between a cloth holding position as shown in FIG. 2 and a retracted position at which the frame member 12 is apart from the movable plate 10. Specifically, the frame member 12 is neutrally urged to be located at the retracted position due to urging force of a spring (not shown). When a solenoid 14 provided in the arm 6 is energized, the frame member 12 is moved toward and urged against the movable plate 10 so that a working cloth can be firmly held therebetween.

At a front end portion of the arm 6, a needle rod 16 which reciprocates in up-and-down direction is provided, and at a lower end of the needle rod 16, a sewing needle 18 is secured.

Further, as shown in FIG. 1, an operation unit 20 and a programmer 22 are provided on the sewing desk 3. The operation unit 20 is operated by a user when sewing operation is to be performed. While, the programmer 22 is operated when sewing data is to be processed (e.g., created, edited, deleted or the like). The programmer 22 is connected to the sewing machine 1 by means of a cable 24, and can be detached from the sewing machine 1. It should be noted that, the programmer 22 can be used for another sewing machine system, i.e., can be connected to another sewing machine with use of the capable 24, and used for creating a sawing program in association with the connected sewing machine.

Figure 3:
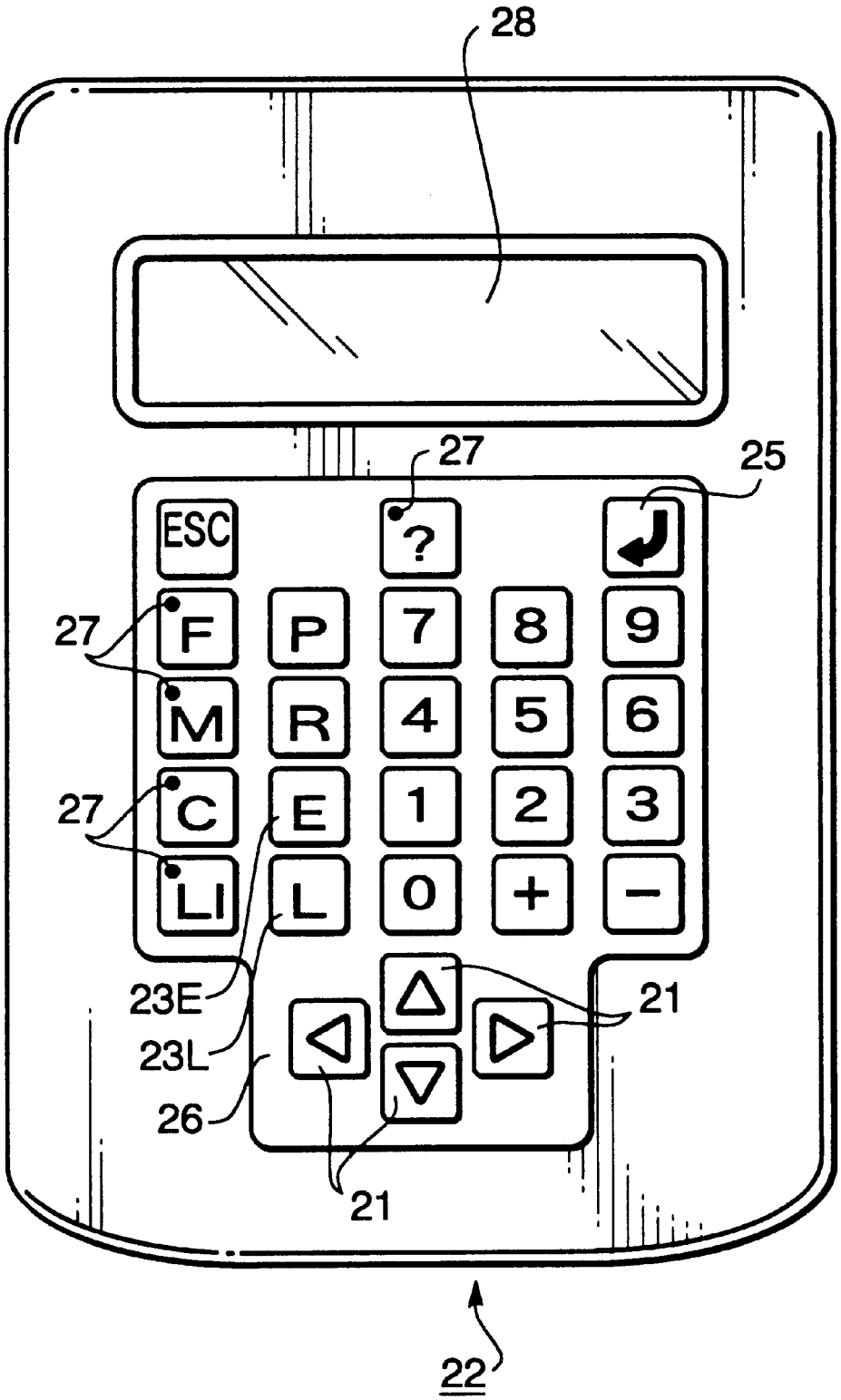
FIG. 3 is a front view of a programmer equipped in the sewing machine system shown in FIG. 1.

FIG. 3 shows a front view of the programmer 22. The programmer 22 has an operation panel 26 provided with a plurality of keys for inputting various commands, data to edit sewing data. An enter key 25, arrow keys 21, an "L" key 23L which is used for switching a flag FL (which will be described later), an "E" key 23E which is used for inputting an "END" command are also provided on the operation panel 26. On each of "?", "F", "M", "C", "LI" keys, an LED 27 is provided. The LED 27 is lit when the key on which the LED is provide is operable. Further, the programmer 22 has a dot matrix type LCD (Liquid Crystal Device) 28 having a 248×60 dot display screen.

In the sewing machine system 100, a flexible disk (not shown) is used as a data recording medium. As shown in FIG. 1, on one side below the sewing desk 3, a casing 30 accommodating a control system of the sewing machine 1 is provided. The casing 30 also accommodates a flexible disk drive 32. Into the flexible disk drive 32, the flexible disk (not shown) is to be inserted. Sewing data (data files) to be read and/or to be edited by the operator is stored in the flexible disk. Further, below the sewing desk 3, on the floor, a pedal switch 34 used for starting/stopping of sewing operation, up/down movement of the frame member 12 is provided.

Figure 4:
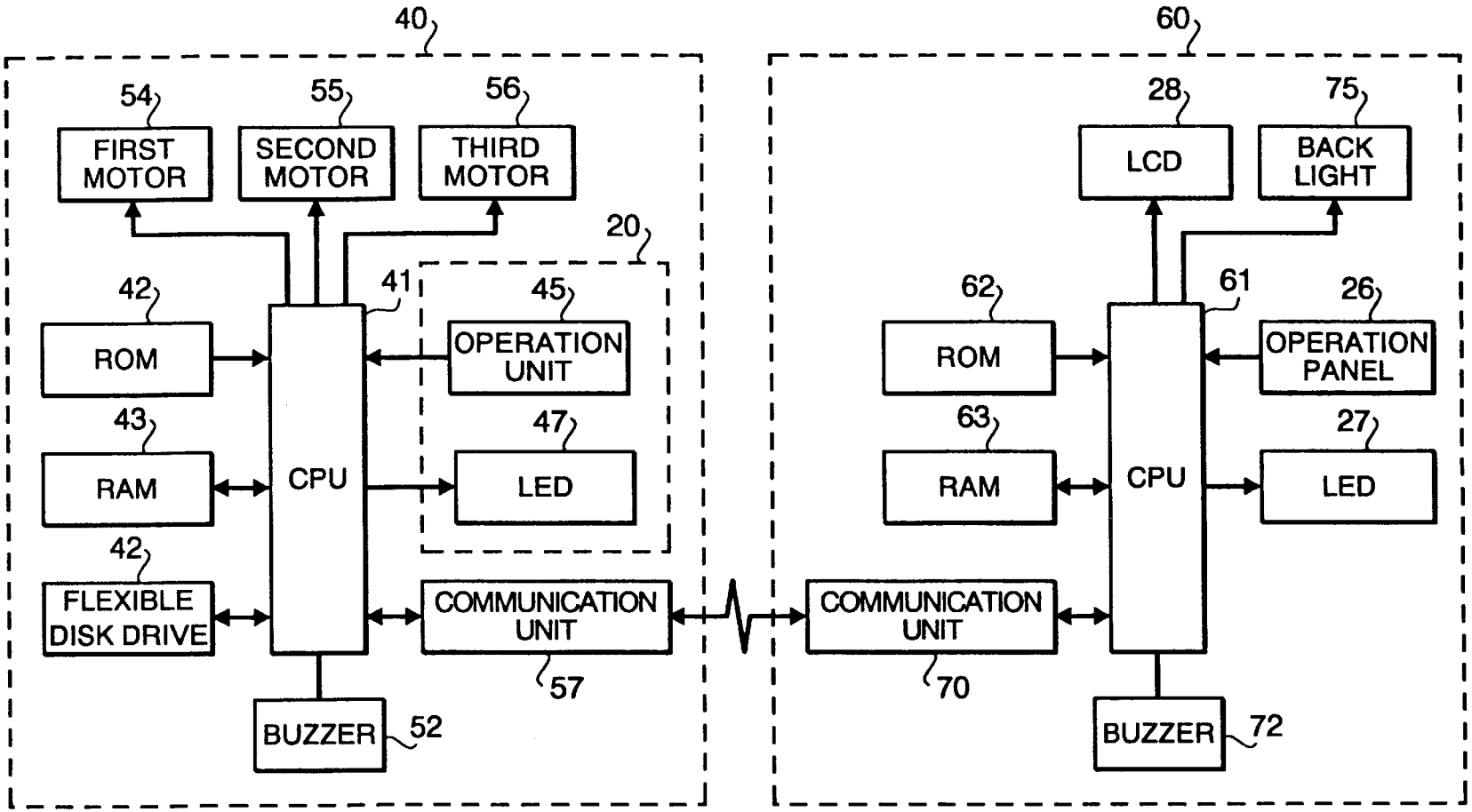
FIG. 4 is a block diagram of the control systems of the sewing machine shown in FIG. 2 and the programmer shown in FIG. 3.

FIG. 4 is a block diagram showing the control systems of the sewing machine system 100. As shown in FIG. 4, the sewing machine system 100 include two control systems: a control system 40 of the sewing machine 1; and a control system 60 of the programmer 22. The control systems 40 and 60 are capable of exchanging data through the cable 24.

The control system 40 includes a CPU 41, a ROM 42, a RAM 43, an operation panel 45, LED's 47, a communication unit 50, a buzzer 52, a first motor 54, a second motor 55, a third motor 56, the flexible disk drive 32 and the like.

The CPU 41 controls the entire operation of the sewing machine 1. In the ROM 42, various programs to be executed by the CPU 41 are stored. The RAM 43 has a program storing area for temporarily storing sewing data. When the automatic sewing operation is performed, the CPU 41 controls the operation of the sewing machine 1 in accordance with the sewing data stored in the program storing area of the RAM 43. Further, in the embodiments, when the sewing data is created, the data is accumulated in the RAM 43 before stored in the flexible disk.

The operation panel 45 is provided with a plurality of keys (not shown), and provided on the operation unit 20. The LED's 47 are also provided on the operation unit 20 for indicating operation conditions, and for warning. The buzzer 52 is provided for indicating an error condition or the like by sound. The first motor 54 and the second motor 55 respectively drive the cloth holding device 8 in X and Y directions, X and Y axes being indicated in FIGS. 1 and 2. The third motor 56 drives a sewing mechanism including the needle rod 16, a loop taker mechanism (not shown) and the like.

The control system 60 includes a CPU 61, a ROM 62, a RAM 63, the operation panel 26, the LED's 27, the communication unit 70, a buzzer 72. the LCD 28, and a back light 75.

The CPU 61 controls the entire operation of the programmer 22. The ROM 62 stores various programs to be executed by the CPU 61. The RAM 63 temporarily stores data when the CPU 61 operates.

The buzzer 72 is for indicating an error condition of the programmer 22 by sound. The back light 75 is used for illuminating the LCD 28 from behind to improve contrast of the displayed image.

The communication units 50 and 70 are interfaces for allowing serial data transmission via the cable 24.

Although not shown in the drawings, the ROM 42, the RAM 43, the communication unit 50 are connected to the CPU 41 through a bus. While, the operation panel 45, the LED's 47, the buzzer 52, the first motor 54, the second motor 55, the third motor 56, the flexible disk drive 57 are connected to respective interface circuits, which are connected to the CPU 41 through the bus.

Similarly, the ROM 62, the RAM 63, the communication unit 70 are connected to the CPU 61 through a bus. While, the operation panel 26, the LED's 27, the buzzer 72, the LCD 28, the back light 75 are connected to respective interface circuits, which are connected to the CPU 61 through the bus.

Figure 5A:
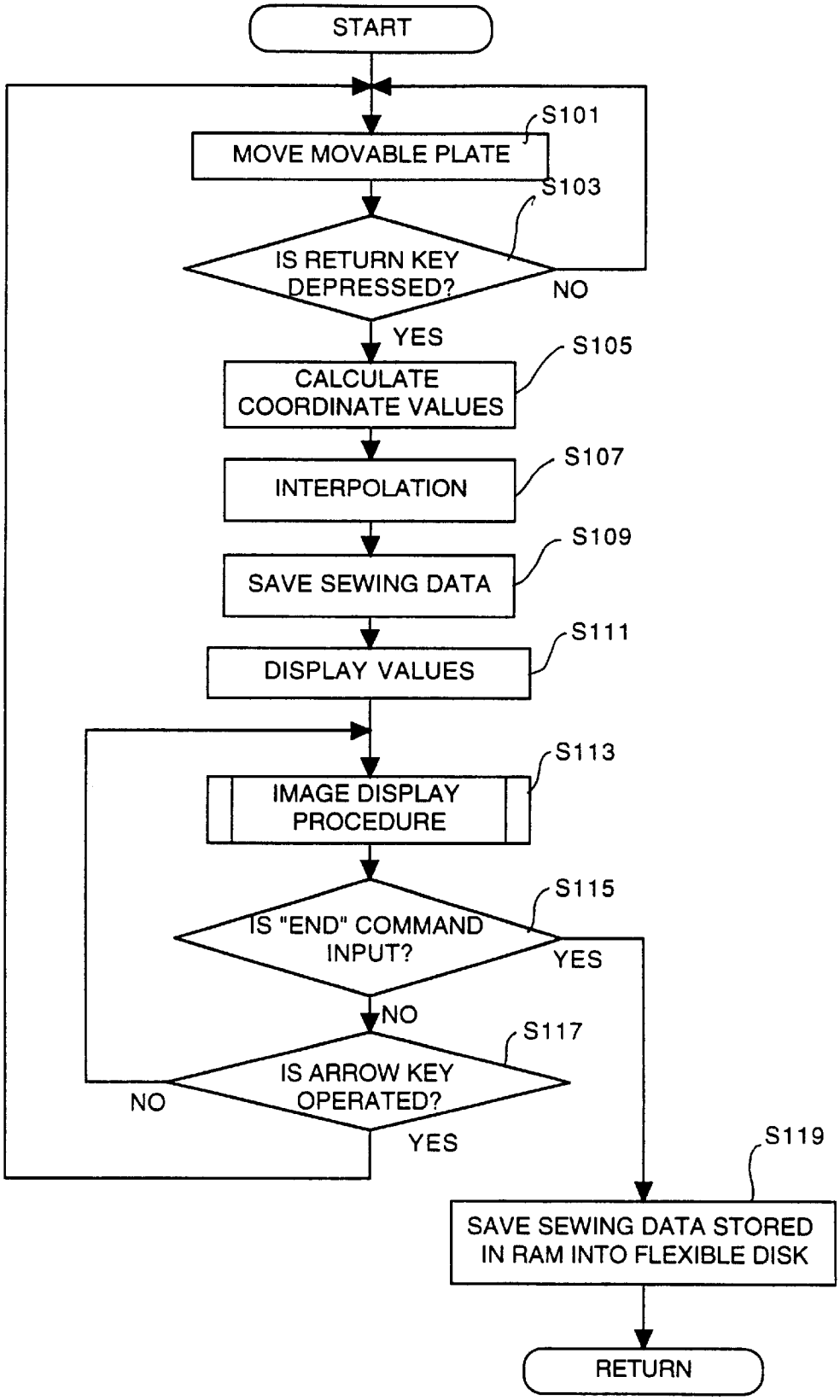
FIG. 5A is a flowchart illustrating sewing data creating procedure according to a first embodiment of the invention.
Figure 5B:
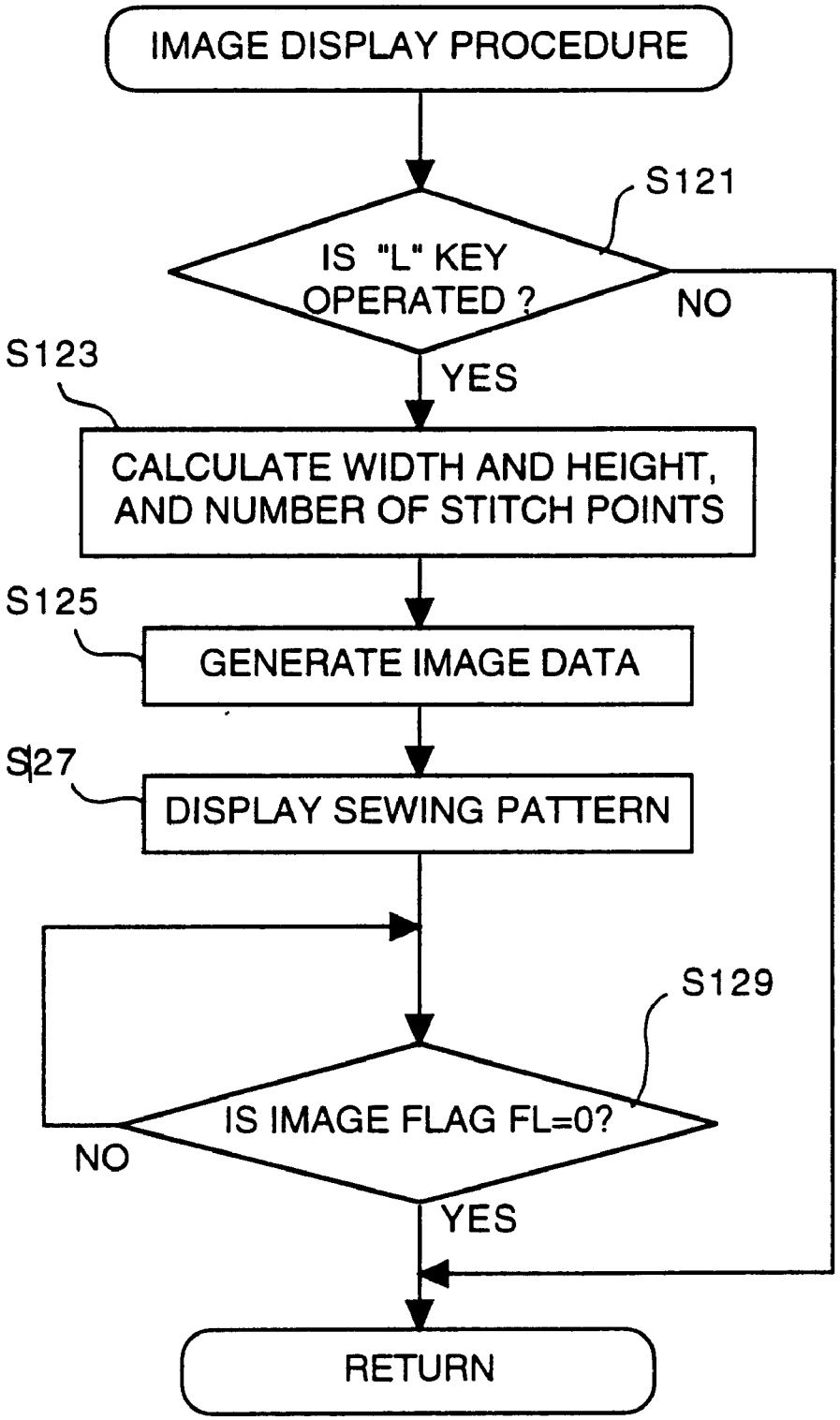
FIG. 5B is a flowchart illustrating an image display procedure which is a subroutine called in the sewing data creating procedure shown in FIG. 5A.

FIGS. 5A shows a flowchart illustrating sewing data creating procedure, and FIG. 5B shows a flowchart illustrating an image displaying procedure which is called in the sewing data creating procedure shown in FIG. 5A, both stored in the ROM 62 of the programmer 22 as programs executed by the CPU 61.

The sewing data creating procedure is initiated when sewing data creation mode is selected via the operating panel 26 It is possible to select, through the operating panel 26, a sewing mode for actually performing a sewing operation, a trace mode for operating the needle rod 16 and the movable plate 10 without the material to be sewed in accordance with sewing data, and some other mode, which will not be described.

In the sewing data creating procedure, in response to operation of arrow keys 21 provided on the programmer 22, the first motor 54 and/or the second motor 55 are driven (S101) to move the movable plate 10 Until the return key 25 is depressed (S103:NO), step S101 is repeated. Accordingly, an operator can locate the movable plate, and accordingly the frame member 12 at a desired position before depressing the return key 25. It should be noted that, when the arrow keys 21 are not operated, nothing is done at S101.

When the return key 25 is depressed (S103:YES), based on a previous position and a moving amount of the movable plate 10, the relative X and Y coordinates of the stitch point with respect to those of the previously determined stitch point, and the absolute X and Y coordinates of the stitch point are calculated at S105. The absolute coordinates represent the X and Y coordinate values of the stitch point relative to the predetermined original point, which is intrinsic to the sewing machine 1, defined within a sewing area of the frame member 12, while the relative coordinate values represent the X and Y coordinate values relative to those of the previously input stitch point.

Based on the X and Y coordinates of the stitch point corresponding to the position of the movable plate 10 when the return key 25 is depressed are obtained as above, intermediate points between the previous stitch point and the current stitch point are interpolated (Step S107), and X and Y coordinates of thus obtained intermediate points are calculated. Then, the X and Y coordinates of the current stitch point and the intermediate points are saved, at S109, in the RAM 43 as sewing data. Thus, the sewing data as illustrated in FIG. 6B are accumulated in the RAM 43 upon each operation of the return key 25 at S103.

In the sewing machine system 100 according to the embodiments, various interpolation methods are available, and an operator can select a desired interpolation method when the sewing data of a pattern is being created. Such interpolation methods may use a line, an arc, a circle, a curved line, and the like. Depending on the selected interpolation method, the number of points to be input and/or how the points to be input may be different. For example, when interpolation using a circle is selected, by designating the center, and a point on the circle to be formed, the circle is defined and all the points on the circle can be determined. If a linear interpolation is selected, by inputting two points defining a line segment, all the points on the line segment can be interpolated. It should be noted that when the intermediate points are interpolated, a pitch of the stitches are taken into account.

Figure 6A:
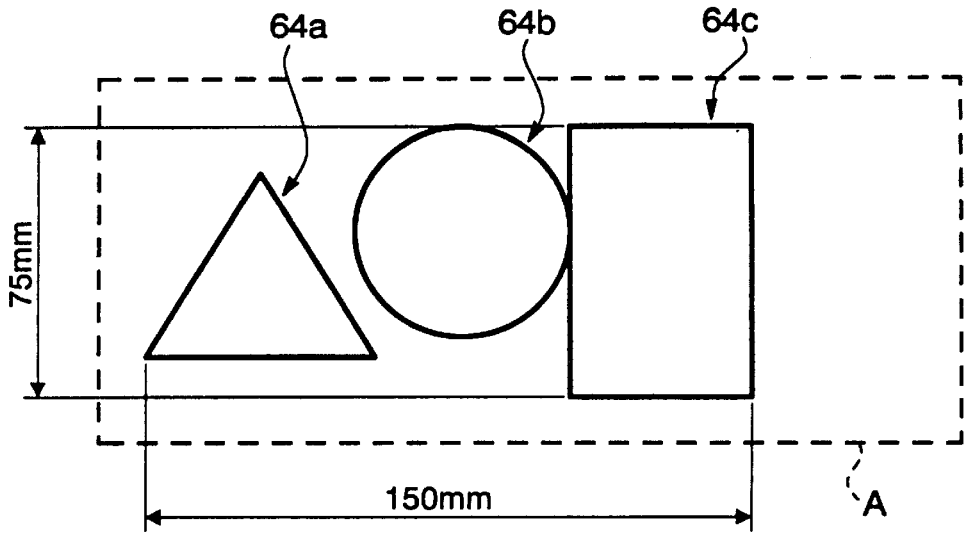
FIG. 6A shows sewing pattern prepared in a sewing data creating procedure.
Figure 6B:
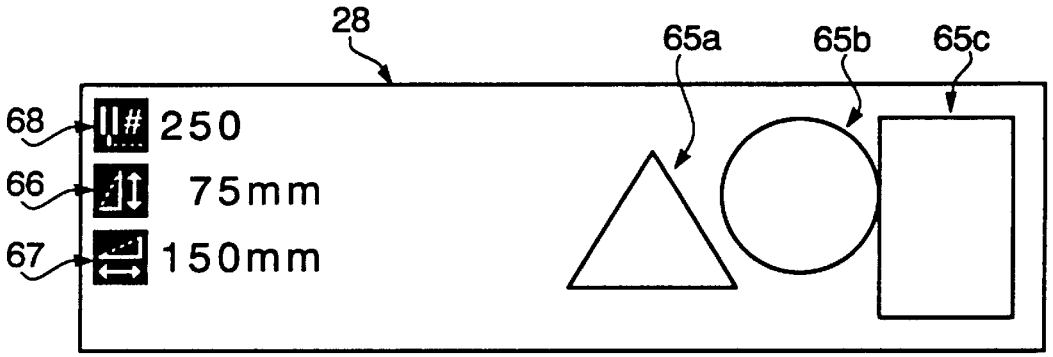
FIG. 6B shows the state that the sewing pattern shown in FIG. 5A is displayed on an LCD.

The former method may be used to create the sewing data of a circle 64*b* in FIG. 6A, while the latter method may be used to create sewing data for a triangular shape pattern 64*a* and a rectangular shape pattern 64*c*. In FIG. 5A, in order to simplify the description, a case where the linear interpolation is applied is explained, and therefore, inputting only one point, the intermediate points between the previously input stitch point and the currently input stitch point are interpolated.

Figure 6C:
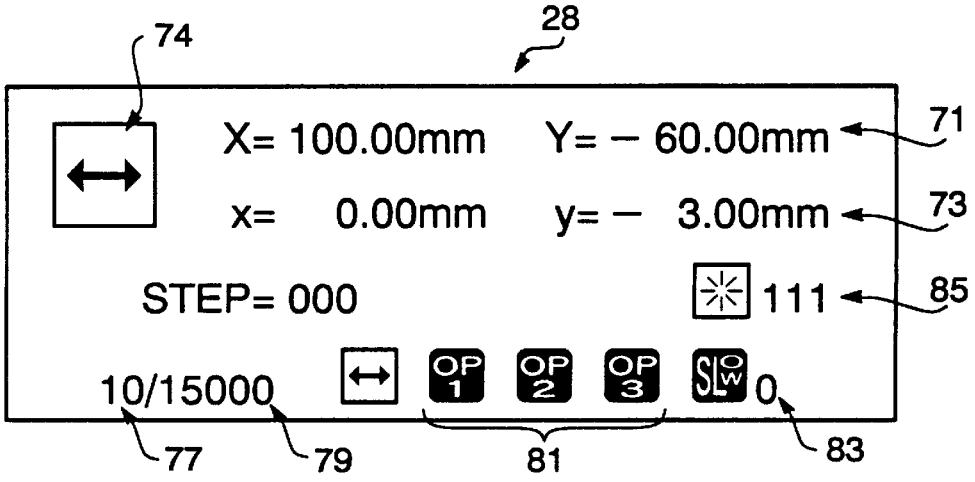
FIG. 6C shows the state that numerical data are displayed.
Figure 7A:
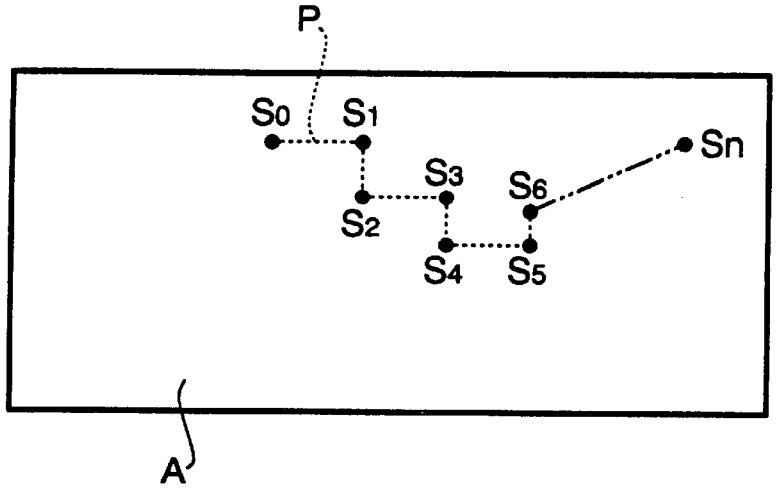
FIG. 7A shows a relationship between input significant points and calculated intermediate points.
Figure 7B:
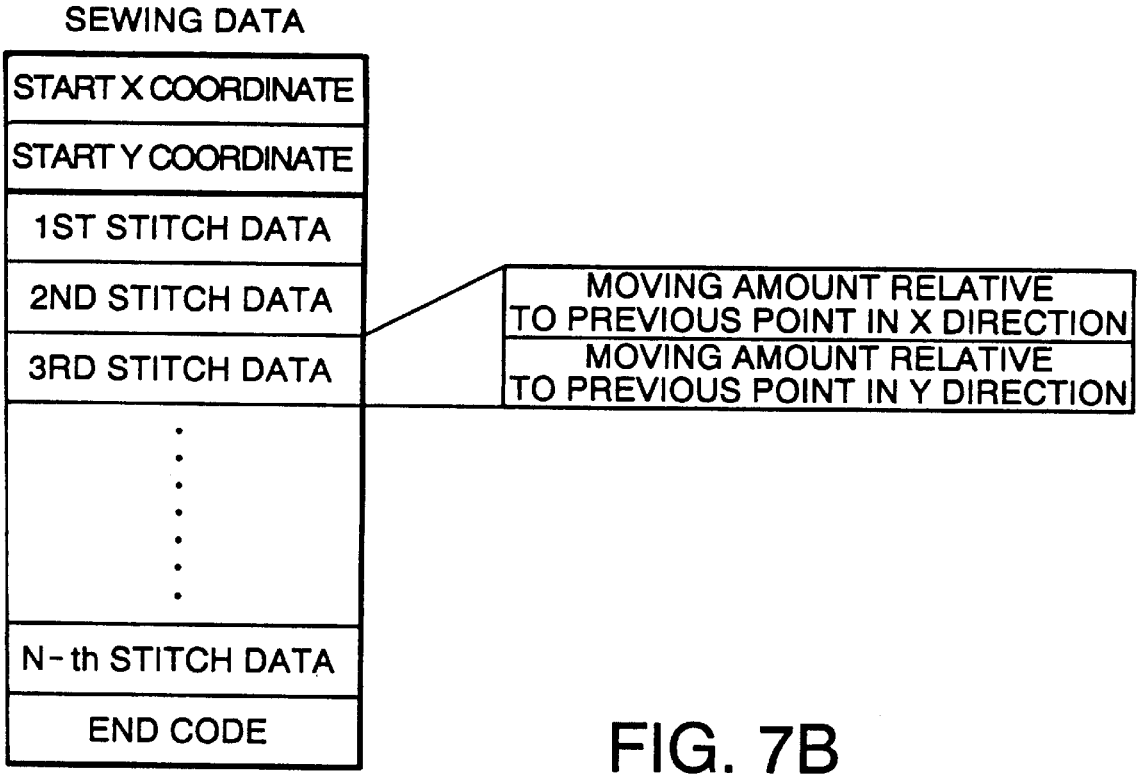
FIG. 7B shows an example of a structure of sewing data representing the stitch points.

At S111, the positional data values, i.e., X and Y coordinates and some other numerical information are displayed on the LCD 28 as illustrated in FIG. 6C.

In FIG. 6C, reference numerals 71 and 73 denote the absolute coordinate values and relative coordinate values, respectively. Reference numeral 74 represents a method used in an interpolation mode, and in this figure, a linear interpolation mode is selected, i.e., two successively input points represents a line segment, and the intermediate points are calculated to align on the line segment. Reference numeral 77 indicates the number of stitches. Indication of "10/15000" means that the total number of stitch points is 15000, including the calculated intermediate points, and the sewing needle is currently placed at the 10th stitch point. Reference numeral 81 indicates that signals for optional devices are output at the 10th stitch point, and reference numeral 81 indicates a sewing speed setting.

At S113, an image display procedure, which is a subroutine is called. The procedure is for switching the display mode between a mode where information is indicated with numerical values and alphanumerical characters, and another mode where information is indicated with graphic image.

FIG. 5B illustrates the image display procedure.

At S121, it is checked whether the "L" key 23L is operated. As described above, the "L" key 23L is for switching the image flag FL between 0 and 1, and the initial value of the image flag is FL. If the "L" key 23L is not operated (S121:NO), the image display procedure is terminated, and control proceeds to S115 of FIG. 5A.

If the "L" key 23L is operated (S121:YES), the image flag FL is changed for 0 to 1. Then, at S123, the width, the height are calculated based on the sewing data stored in the RAM 43, and further, the number of stitch points included in the sewing data is obtained. The width of the pattern can be obtained by computing the absolute X coordinate of respective stitch points, and subtracting the minimum value from the maximum value thereof. The height of the pattern can be similarly obtained from the maximum and minimum values of the absolute Y coordinates. The width and height of the exemplary pattern illustrated in FIG. 6A are 150 mm W and 75 mm H as indicated in the drawing.

The number of stitch points is the sum of the number of the stitch points including the intermediate stitch points interpolated at S105 of the sewing data creating procedure shown in FIG. 5A.

At S125, image data of the sewing pattern, which would be formed if the sewing machine performs the automatic sewing operation in accordance with the currently created sewing data, is generated based upon the data stored in the RAM 41. The CPU 61 controls the LCD 28 to display the pattern in accordance with thus generated image data. It should be noted that when the image data is generated, the size of the displayed image is adjusted (magnified or reduced), based on the size of the display area of the LCD 28 and the width and height obtained at S123, so that the entire pattern can be displayed on the LCD 28.

Then, at S127, the image data generated at S125 and the numerical data obtained at S123 are displayed on the LCD 28. An example of the displayed image is illustrated in FIG. 6B. Icons 66, 67 and 68 indicate, respectively, the actual width, the actual height and the number of stitch points of the displayed pattern when it is actually sewn. Thus, the operator can confirm the shape of the pattern of which the sewing data is being created, and the actual size thereof.

At S129, it is checked whether the image flag FL equal 0. The procedure of S123 through S127 is executed when the image flag FL equals 1. Accordingly, if the "L" key 23L is not operated, control stays at S129. When the "L" key 23L is operated, the image flag FL is changed to 1, and control exits the image display procedure and goes to S115 of FIG. 5A.

After control returns from the image displaying procedure to S115 of the sewing data creating procedure, it is checked whether the process is to be terminated. This termination is to be instructed through the operating panel by depressing the "E" key (the END key) 23E. If the "E" key is not depressed, it is checked whether the arrow keys 21 are operated at S117. If the arrow keys 21 are not operated, control returns to S113 to constitute a loop.

Thus, after the numerical values are displayed at S111, control waits for operation of the "L" key 23L, the "E" key 23E, or arrow keys 21. If the "L" key 23L is operated, as described above, the graphic image of the sewing pattern is displayed on the LCD 28. The image of the sewing pattern is kept displayed on the LCD 28 until the "L" key 23L is operated again. Accordingly, the operator can confirm the shape of the pattern corresponding to the input sewing data temporarily by switching the display mode. Then, by operating the "L" key 23L again, the operator can switch the display mode to the normal mode, and continue the creation of the sewing data or terminate the procedure, by operating the arrow keys 21 or the "E" key 23E.

If the "E" key 23E is depressed (S115:YES) during the loop of steps S113, S115 and S117 is executed, control goes to S119, where the sewing data saved in the RAM 43 is stored in the flexible disk inserted in the flexible disk drive 32, and the sewing data creating procedure is terminated.

Thus, an operator can visually confirm the shape of the sewing pattern when creating the sewing data simply by depressing the "L" key 23L once, and then the display can be returned, by depressing the same key 23L again, to the state illustrated in FIG. 6C for continuing creation of the sewing data. In other words, according to the first embodiment, the sewing machine system 100 has, when sewing data is created, a data input mode in which sewing data is input with use of the programmer 22, and a confirmation mode which allows the operator to confirm the input sewing data represents the intended pattern. According to the first embodiment, when the image of the pattern is displayed, input of the sewing data is prohibited since control stays at S129.

It should be noted that step S129 of FIG. 5B can be modified such that control pauses for predetermined period of time, and then set the image flag FL to 0 and exit the image display procedure. In such a case, the image of the pattern is displayed on the LCD 28 for the predetermined period of time, and then the numerical data is displayed and data input can be continued.

Figure 8A:
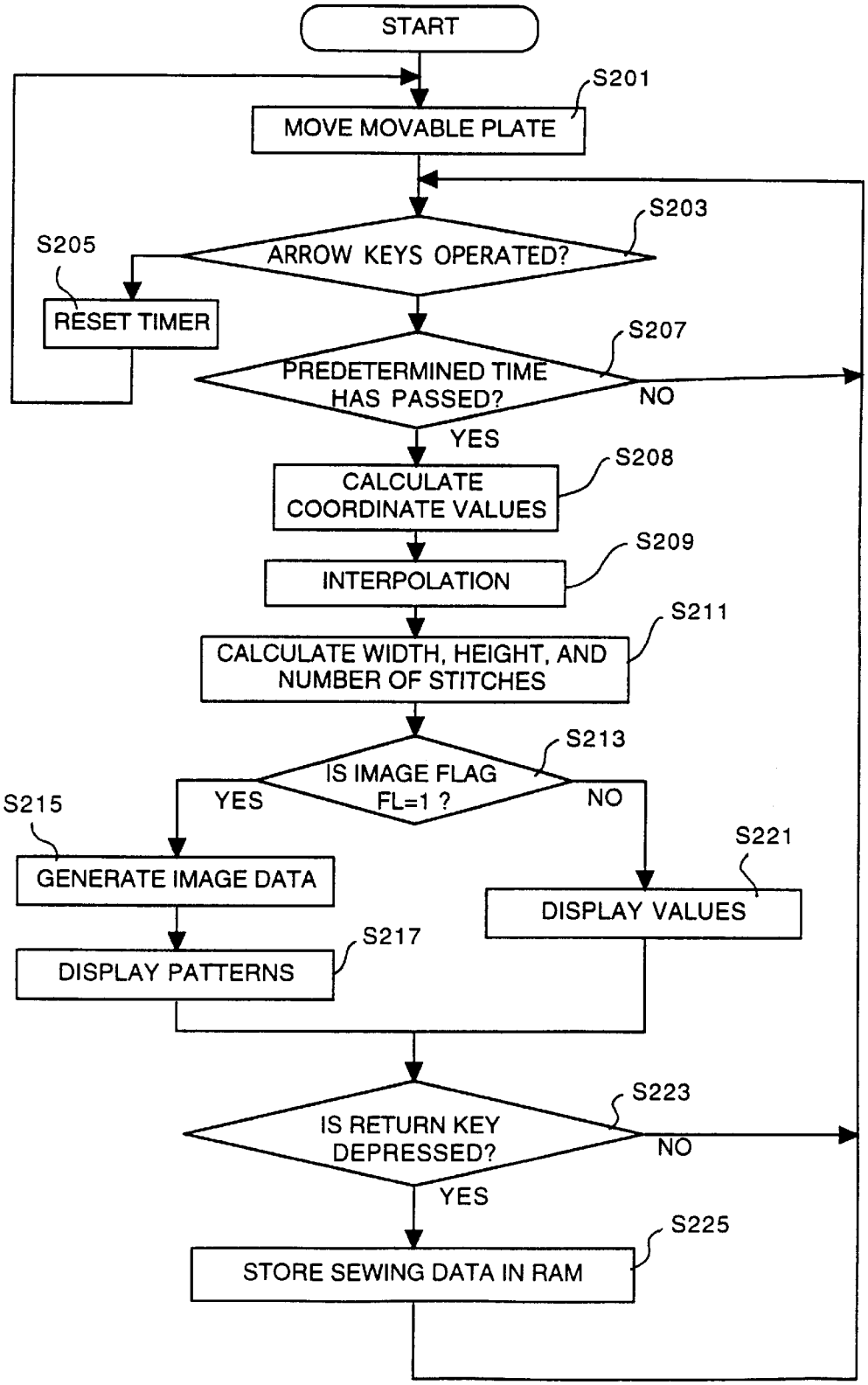
FIG. 8A shows a flowchart illustrating sewing data creation procedure according to a second embodiment of the invention.
Figure 8B:
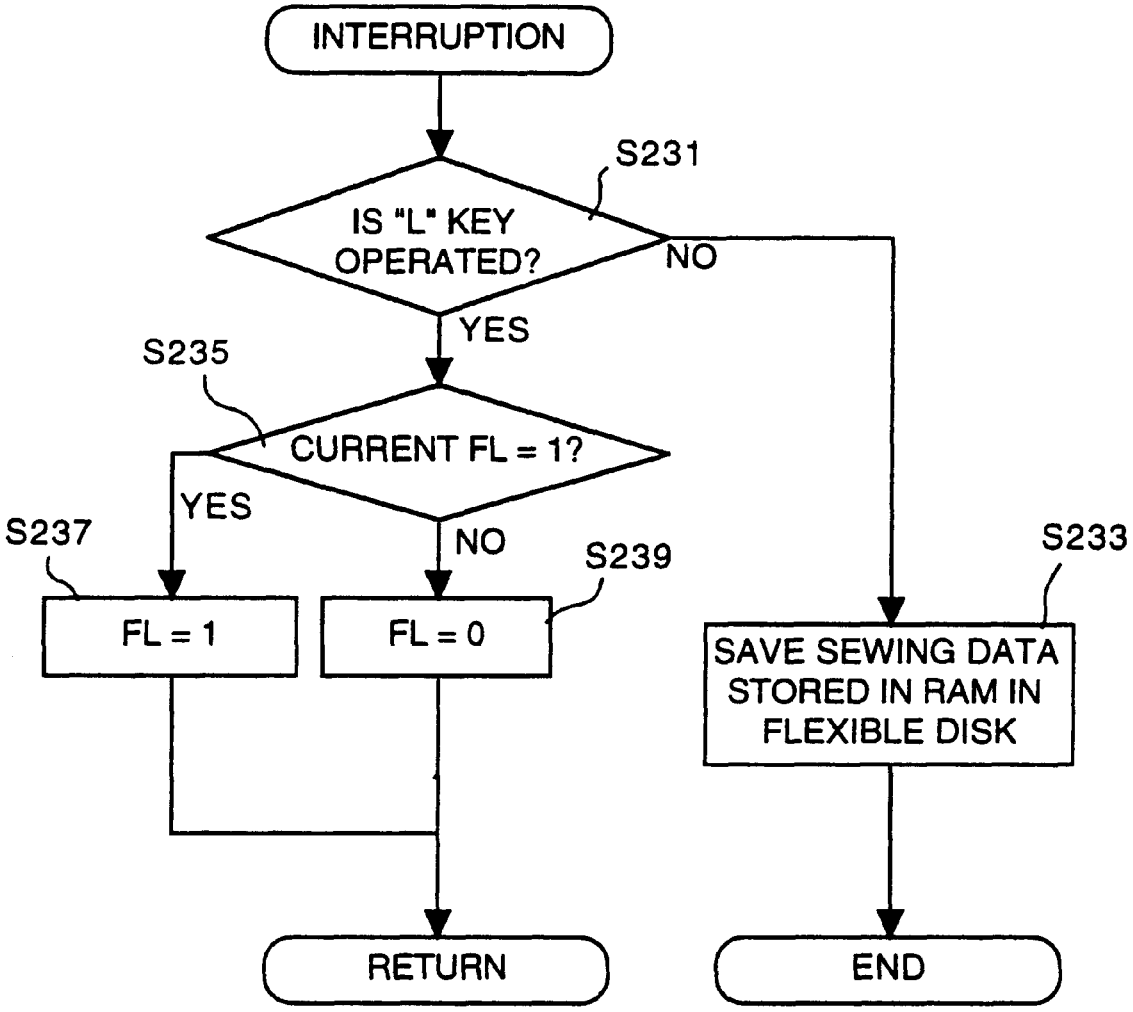
FIG. 8B is a flowchart illustrating an interruption which is executed when the sewing data creation procedure shown in FIG. 8 is being executed.

FIGS. 8A shows a sewing data creating procedure according to the second embodiment of the invention. FIG. 8B is an interruption procedure which is executed when the "L" key 23L or the "E" key 23E is depressed when the data creating procedure shown in FIG. 8A is being executed.

In the first embodiment, the image of the sewing pattern can be temporarily displayed so that the operator can confirm the shape of the sewing pattern corresponding to the sewing data being created.

In the second embodiment, the operator can create the sewing data with monitoring either the image of the pattern or the numerical values. Similarly to the first embodiment, the sewing data creating procedure shown in FIG. 8A is initiated when sewing data creation mode is selected via the operating panel 26.

At S201, in response to operation of arrow keys 21, the first motor 54 and the second motor 55 are driven to move the movable plate 10 in the X and Y directions, respectively. If the arrow keys 21 are not operated, nothing is done at S201, and determination made at S203 is NO. At S207, it is checked whether a predetermined period of time has passed with reference to a timer included in the CPU 61. If the predetermined period has not passed (S207:NO), controls goes to S203. If the arrow keys 21 have not been operated for the predetermined period, control proceeds from S207 to S209. If the arrow keys 21 are operated when steps S203 and S205 are repeated, the timer is reset (S205), and the first and second motors 54 and 55 are controlled to move the movable plate 10 in accordance with the operation of the arrow keys 21 (S201).

At S208, the absolute and relative X and Y coordinates values of a stitch point corresponding to the current position of the movable plate 10 are calculated.

At S209, based on the previously input stitch point and the stitch point corresponding to the current position of the movable plate 10, the X and Y coordinates of the intermediate points are interpolated, similarly to the first embodiment.

At S211, the width, height of the sewing pattern is calculated based on the sewing data stored in the RAM 43, and the values calculated at S209 so as to include the width and height of the pattern including the currently processed portion.

At S213, it is checked whether the image flag FL is 1 or 0. If the image flag FL equals 1, the graphic image of the sewing pattern is displayed on the LCD 28, while if the image flag FL equals 0, the numerical values are displayed on the LCD 28.

If the image flag FL equals 1 (S213:YES), the image data to be used for displaying the graphic image on the LCD 28 is generated. Then, at S217, the image of the sewing pattern corresponding to the currently processed sewing data is displayed on the LCD 28.

If the image flag FL equal 0 at S213, the numerical data representing the stitch point corresponding to the current position of the movable plate 10 is displayed on the LCD 28 (S221).

At S223, it is checked whether the return key 25 is depressed. If not, controls returns to S203, and above-described procedure is repeated until the return key 25 is depressed. If the return key 25 is depressed (S225: YES), then the data calculated at S211 is stored in the RAM 32 as the sewing data, and control returns to S203.

Accordingly, when the operator moves the movable plate 10, the displayed image or numerical values are updated regardless whether the data is stored or not. Therefore, the operator can confirm the new stitch points to be added is appropriated by monitoring the image or the numerical values which are updated in response to the movement of the movable plate 10, and after the confirmation, the operator may store the sewing data by depressing the return key 25.

FIG. 8B shows the interruption procedure for switching the image flag FL.

As described above, the interruption shown in FIG. 8B is initiated when the "L" key 23L or the "E" key 23E is operated. When the "L" key 23L is operated (S231:YES), if the current image flag FL is 0 (S235:NO), the image flag FL is set to 1 (S237), while if the current image flag FL is 1 (S235:YES), then the image flag FL is set to 0 (S239), and the interruption is terminated. IF the "E" key 23E is operated (S231:NO), the data stored in the RAM 43 (i.e., the sewing data) is saved in the flexible disk inserted in the flexible disk drive 32 (S233).

The present disclosure relates to subject matter contained in Japanese Patent Application No. HEI 09-140334, filed on May 29, 1997, which is expressly incorporated herein by reference in its entirety.

What is claimed is:

1. A sewing machine system, comprising:

an electronically controlled sewing machine;

a programmer which is electronically connected to said sewing machine, said sewing machine being capable of performing an automatic sewing operation in accordance with sewing data, said programmer being capable of creating sewing data by inputting positional data in cooperation with said sewing machine, said programmer comprising:

a display device for visually displaying data; and an image data generating device that generates image data based on said sewing data being created by said programmer, and said programmer operating in either one of a confirmation mode and a data input mode, said display device displaying numerical data related to input positional data when said programmer is operating in said data input mode, and said display device displaying an image of a pattern representing sewing data, which is being created, in accordance with said image data generated by said image data generating device when said programmer operates in said confirmation mode.

2. The sewing machine system according to claim 1, wherein said programmer further comprising a controller which prohibits data input when said programmer operates in said confirmation mode.

3. The sewing machine system according to claim 1, wherein said display device displays alphanumerical information related to said image of said pattern together with said image of said pattern when said programmer operates in said confirmation mode.

4. The sewing machine system according to claim 3, wherein said alphanumerical information includes an actual size of said pattern.

5. A sewing machine system comprising an electronically controlled sewing machine and a programmer electronically connected to said sewing machine, said sewing machine being capable of performing an automatic sewing operation in accordance with sewing data, said programmer being capable of creating sewing data in cooperation with said sewing machine, said programmer comprising:

a display device for visually displaying data;

an image data generating device that generates image data based on said sewing data being created by said programmer;

a selecting device which is manually operated to select one of a first mode and a second mode;

a display control device that controls said display device to display numerical data related to currently created sewing data when said first mode is selected by said selecting device, and to display an image of a pattern corresponding to said currently created sewing data in accordance with said image data generated by said image data generating device.

6. The sewing machine system according to claim 5, wherein said display control device controls said display to display alphanumerical information related to said pattern together with said image of said pattern when said second mode is selected.

7. The sewing machine system according to claim 6, wherein said alphanumerical information includes an actual size of said pattern when it is formed by said electronically controlled sewing machine.

8. The sewing machine system according to claim 5, further comprising a controller which prohibits creation of said sewing data when said second mode is selected and said image of said pattern is being displayed.

9. The sewing machine system according to claim 5, wherein said programmer further comprising:

a positional data input device that inputs positional data representing a plurality of points located on a pattern to be formed; and an interpolating device that interpolates positional data of intermediate points between said plurality of points located on said pattern to be formed.

10. A programmer which is connected to an electrically controlled sewing machine, said sewing machine being capable of performing an automatic sewing operation in accordance with sewing data, said programmer being capable of creating sewing data by inputting positional data in cooperation with said sewing machine, said programmer comprising:

a display device for visually displaying data; and an image data generating device that generates image data based on said sewing data being created by said programmer, and said programmer operating in either one of a confirmation mode and a data input mode, said display device displaying a numerical data related to input positional data when said programmer operates in said data input mode, and said display device displaying an image of a pattern representing a sewing data, which is being created, in accordance with said image data generated by said image data generating device when said programmer operates in said confirmation mode.

11. A method of displaying sewing data employed in a sewing machine system including an electronically controlled sewing machine and a programmer, said sewing machine being capable of performing an automatic sewing operation in accordance with sewing data, said programmer being capable of creating sewing data by inputting a positional data in cooperation with said sewing machine, said programmer having a displaying device, said method comprising the steps of:

creating sewing data;

optionally switching a display mode of said displaying device between a first mode and a second mode when the sewing data is created;

displaying alphanumerical characters on said displaying device when said first mode is selected; and generating an image data representing a pattern image in accordance with a sewing data currently created and displaying the pattern image on said displaying device when said second mode is selected.

12. The method according to claim 11, further comprising a step of displaying alphanumerical information related to said pattern together with said pattern image when said second mode is selected.

13. The method according to claim 12, further comprising a step of prohibiting creation of the sewing data when said second mode is selected.

14. A computer accessible memory for storing a program to be executed by a computer, said program contains a method for displaying sewing data employed in a sewing machine system including an electronically controlled sewing machine and a programmer, said sewing machine being capable of performing an automatic sewing operation in accordance with a sewing data, said programmer being capable of creating sewing data by inputting positional data in cooperation with said sewing machine, said programmer having a displaying device, said method comprising the steps of:

creating sewing data;

optionally switching a display mode of said displaying device between a first mode and a second mode when the sewing data is allowed to be created;

displaying alphanumerical characters on said displaying device when said first mode is selected; and generating image data representing a pattern image in accordance with sewing data currently created and displaying the pattern image on said displaying device when said second mode is selected.

* * * * *

UNITED STATES PATENT AND TRADEMARK OFFICE

CERTIFICATE OF CORRECTION

PATENT NO. : 6,000,351

DATED : December 14, 1999

INVENTOR(S) : Shinji Yoshida et al.

It is certified that error appears in the above-identified patent and that said Letters Patent is hereby corrected as shown below:

On the title page, item [75], please correct the first inventor's name to read:
SHINJI YOSHIDA

Signed and Sealed this

Fifth Day of September, 2000

*Attest:*

*Attesting Officer*

Q. TODD DICKINSON

*Director of Patents and Trademarks*